US008011942B2

(12) United States Patent
Ohmori et al.

(10) Patent No.: US 8,011,942 B2
(45) Date of Patent: Sep. 6, 2011

(54) CONNECTOR

(75) Inventors: Yasuhiro Ohmori, Yao (JP); Masahiko Nakamura, Yao (JP)

(73) Assignee: Hosiden Corporation, Osaka (JP)

( * ) Notice: Subject to any disclaimer, the term of this patent is extended or adjusted under 35 U.S.C. 154(b) by 29 days.

(21) Appl. No.: 12/684,307

(22) Filed: Jan. 8, 2010

(65) Prior Publication Data

US 2010/0178789 A1 Jul. 15, 2010

(30) Foreign Application Priority Data

Jan. 13, 2009 (JP) ..... 2009-005014

(51) Int. Cl.
*H01R 13/213* (2006.01)

(52) U.S. Cl. ..... 439/314; 439/352; 439/474

(58) Field of Classification Search ..... 439/314, 439/352, 474
See application file for complete search history.

(56) References Cited

U.S. PATENT DOCUMENTS

| | | | | |
|---|---|---|---|---|
| 4,239,325 | A | 12/1980 | Tyson | |
| 4,429,938 | A * | 2/1984 | Flor | 439/314 |
| 4,634,204 | A * | 1/1987 | Detter et al. | 439/347 |
| 4,690,495 | A * | 9/1987 | Giannini | 385/57 |
| 4,867,523 | A * | 9/1989 | Scott, Jr. | 385/60 |
| 4,932,887 | A | 6/1990 | Kataoka et al. | |
| 5,123,852 | A * | 6/1992 | Gillett | 439/67 |
| 5,263,871 | A * | 11/1993 | Sano | 439/157 |
| 5,718,597 | A | 2/1998 | Kodama | |
| 5,984,705 | A | 11/1999 | Miyazaki et al. | |
| 6,296,508 | B1 | 10/2001 | Kuwahara et al. | |
| 6,461,179 | B1 * | 10/2002 | Sullivan et al. | 439/254 |
| 6,464,526 | B1 * | 10/2002 | Seufert et al. | 439/352 |
| 7,530,830 | B1 * | 5/2009 | Lenox | 439/248 |
| 2003/0008555 | A1 | 1/2003 | Obata | |
| 2003/0207607 | A1 | 11/2003 | Matsumoto et al. | |

FOREIGN PATENT DOCUMENTS

| | | | |
|---|---|---|---|
| DE | 202007017521 | U1 | 9/2008 |
| EP | 1381114 | A2 | 1/2004 |
| JP | 63136482 | | 6/1988 |
| JP | 10-162896 | A | 6/1998 |
| JP | 11-135190 | A | 5/1999 |
| JP | 3077696 | B1 | 8/2000 |
| JP | 3191909 | B2 | 7/2001 |
| JP | 2003017191 | | 1/2003 |

* cited by examiner

*Primary Examiner* — Truc T Nguyen
(74) *Attorney, Agent, or Firm* — The Webb Law Firm

(57) ABSTRACT

There is provided a connector that allows easy engagement even when visual judgment is not possible and that has superior durability as well. In a connector for connecting a first connecting cable connected to one end of a socket and a second connecting cable connected to one end of a plug, through engagement between the socket and the plug, the socket includes a cutout portion formed by cutting away at least one portion from one opening of a cylinder along the peripheral direction thereof, the cutout portion having a V-shape at its deepest portion, a first guiding portion projecting from at least one portion of the opening along the peripheral direction, the first guiding portion having a substantial V-shape at its leading end, and a retaining portion to be retained to a lateral face of the cylinder at the time of engagement with the plug, thus retaining this engagement. The plug includes a second guiding portion engageable into the cutout portion and having a substantial V-shape at its leading end and a pawl portion to be retained to the retaining portion at the time of the engagement with the socket.

7 Claims, 8 Drawing Sheets

CONNECTOR

BACKGROUND OF THE INVENTION

1. Field of the Invention

The present invention relates to a connector for connecting a first connecting cable connected to one end of a socket and a second connecting cable connected to one end of a plug, through engagement between the socket and the plug.

2. Description of the Related Art

In electric apparatuses or the like, there are often employed a power cable for power supply and a signal cable for signal transmission. When such power cable or signal cable is physically extended or signal is transmitted to another electric apparatus, cable-to-cable connection is often provided. In such connection, there is often employed a connector configured to realize the desired object through engagement between a socket and a plug, with a cable being attached to one end of the socket and the other cable being attached to one end of the plug. Some examples of connector of this type are known from patent documents identified below.

Japanese Patent Application "Kokai" No. 10-162896 (corresponding to the U.S. Pat. No. 5,984,705) discloses a connector including a pair of connector housings engageable to each other and a locking means for locking the pair of connector housings under their engaged condition.

Japanese Patent Application "Kokai" No. 11-135190 discloses a water-resistant connector consisting of a receptacle-side connector and a plug-side connector. The receptacle-side connector includes an engaging portion that is formed integrally at an outer peripheral portion of the opened end of an insertion hole of the connector. This engaging portion includes an annular engaging member and a supporting member. The annular engaging member is formed coaxially with and disposed with a predetermined distance from the opened end outer peripheral portion. The annular engaging member is formed thin and has a same width as the opened end outer peripheral portion. The supporting member is configured for interconnecting the outer peripheral portion and an inner peripheral face of the annular engaging member. Further, the plug-side connector includes an inserting projection to be loosely inserted into the insertion hole. An O-ring is non-withdrawbly retained on the outer peripheral portion of the inserting projection so that the connector, when inserted, is compressively deformed between the inner peripheral face of the insertion hole and the outer peripheral face of the inserting projection, thus providing liquid-tight seal therebetween. Further, the plug-side connector includes an engaged portion to be non-withdrawbly retained to the annular engaging member.

Japanese Patent No. 3077696 (corresponding to U.S. Pat. No. 6,296,508) discloses a connector including a pair of connector housings which are formed cylindrical and coaxially engageable with each other upon relative axial advancement thereof. This connector includes a positioning means having a groove formed in one of the housings and a rib formed on the other housing. Upon establishment of engagement between the groove and the rib, the pair of housing connectors are restricted in their relative rotation in the peripheral direction and at the same time are allowed to move in the axial direction for mutual engagement. The connector further includes a guiding means for enabling relative rotation between the two connector housings substantially coaxially and peripherally, with no engagement between the groove and the rib.

Japanese Patent No. 3191909 (corresponding to U.S. Pat. No. 5,718,597) discloses a connector having an engagement guiding function. The connector includes a pair of connector housings to be engaged with each other. One of the housings includes a bush portion for receiving the other connector housing. And, at upper and lower and right and left peripheral walls of the bush member, there are provided inclined faces opposed to each other and opened with progressively increasing diameter in the respective engaging direction. End portions in the engaging direction of the adjacent inclined faces are located close to each other and guiding projections are provided at upper and lower and right and left peripheral walls of the other connector housing. Further, at the bottoms of the inclined face opposed thereto, there is formed a retaining hole for receiving the guiding projection.

However, in the case of the connector disclosed in Japanese Patent Application "Kokai" No. 10-162896 (corresponding U.S. Pat. No. 5,984,705), in the course of engagement between the pair of connector housings, if there exists an error between the positions of the locking means provided in the respective connector housings, the locking means are disabled from functioning. Therefore, there arises a need for effecting the alignment between the locking means with visual judgment.

Further, in the case of the water-resistant connector disclosed in Japanese Patent Application "Kokai" No. 11-135190, in the course of the engagement between the receptacle-side connector and the plug-side connector, there is a need for effecting the alignment with visual judgment, just like the locking means of Patent Document 1 above.

In the case of the connector disclosed in Japanese patent No. 3077696 (corresponding U.S. Pat. No. 6,296,508), engagement is possible without relying on visual judgment, by rotating the pair of connector housings in the peripheral direction, with pressing these housings against each other. However, since this rotation under pressure applies an excess stress to the connector housings, there is a need to form the connector housings with a strength sufficient to endure this stress.

Further, in the case of the connector having the engagement guiding function disclosed in Japanese patent No. 3191909 (corresponding U.S. Pat. No. 5,718,597), there is a need to form the guiding projection long enough to be capable of guiding even when one connector housing is displaced maximally in either direction relative to the other connector housing. For this reason, even if the pair of connector housings are engaged appropriately, the guiding projection will project prominently from the connector housing, so that there is a risk of this guiding projection being damaged as being inadvertently hooked with a component or object other than the connector.

SUMMARY OF THE INVENTION

In view of the above-described problems, the principal object of the present invention is to provide a connector that allows easy engagement even when visual judgment is not possible and that has superior durability as well.

For accomplishing the above-noted object, according to the characterizing feature of the present invention, there is provided a connector for connecting a first connecting cable connected to one end of a socket and a second connecting cable connected to one end of a plug, through engagement between the socket and the plug, wherein said socket includes:

a cutout portion formed by cutting away at least one portion from one opening of a cylinder along the peripheral direction thereof, the cutout portion having a V-shape at its deepest portion;

a first guiding portion projecting from at least one portion of said opening along the peripheral direction, the first guiding portion having a substantial V-shape at its leading end, and a retaining portion to be retained to a lateral face of said cylinder at the time of engagement with the plug, thus retaining this engagement;

wherein said plug includes:

a second guiding portion engageable into said cutout portion and having a substantial V-shape at its leading end; and a pawl portion to be retained to said retaining portion at the time of the engagement with the socket.

With the above-described characterizing construction, even when the socket and the plug are located out of alignment in the peripheral direction at the initial stage of engagement, through the cooperation between the cutout portion of the socket and the second guiding portion of the plug, the peripheral orientations of the socket and the plug can be appropriately corrected in the course of the engagement. Therefore, the engagement can be realized easily even under a situation when the visual judgment is not possible. Further, since the peripheral orientations of the socket and the plug are corrected in the course of, i.e. during the engagement as described above, there will occur no damage to the engaging portions of the socket and the plug. Therefore, a connecting having superior durability can be realized.

Preferably, said pawl portion includes, on its rear side in the engaging direction of the socket and the plug, a perpendicular face perpendicular to said engaging direction and includes also, on its front side in the engaging direction, an inclined face inclined to the rear side in the engaging direction, and the pawl portion has a trapezoidal shape in its axial cross section.

With the above-described construction, when the pawl portion of the plug is to be retained to the retaining portion of the socket, as its face on the front side in the engaging direction is formed as an inclined face inclined to the rear side in the engaging direction, there occurs no damage or break in the pawl portion. Further, when the pawl portion of the plug has been retained to the retaining portion of the socket, since the face of the pawl portion on the rear side in the engaging direction is formed as a perpendicular face perpendicular to the engaging direction, the retention can be released easily, thus preventing release of the engagement.

Preferably, on the rear side in the engaging direction of the pawl portion, at least one of the plug and the socket includes a space that allows release by a tool.

With the above-described construction, the retention of the pawl portion can be easily released by inserting a tool into the space.

Still preferably, said plug includes a recess having a predetermined depth.

With the above-described construction, a narrow plate-like rigid member such as a minus driver can be inserted into the recess and then by pivotally raising this rigid tool with the inserted point as the pivotal point, the retention between the retaining portion of the socket and the pawl portion of the plug can be easily released.

Preferably, said plug forms a rib along the axial direction thereof.

With the above-described construction, the insertion of the tool into the recess can be carried out smoothly.

Still preferably, at least one of said first connecting cable and said second connecting cable comprises a three-layered cable having a core wire, a first insulating portion covering the core wire and a second insulating portion covering the first insulating portion; and when said cable is to be connected to at least one of said socket and said plug, there is employed a cable packing to be press-fitted with said first insulating portion.

With the above-described construction, once the cable has been installed, this cable is not be withdraw from the cable packing. Therefore, the light-tightness between the cable and the cable packing can be maintained for an extended period of time. Therefore, even in outdoor use, the water-tightness of the core wire of the cable can be kept reliably.

Still preferably, said cable packing is configured to be compressed upon engagement between at least one of a body constituting said socket and a body constituting said plug and a cap fixed on said bodies to cover said cable packing, thereby to fill the gap therebetween.

With the above-described construction, the liquid tightness can be further enhanced. Further, as the cable packing is press-fitted by the body and the cap, insertion of a contact into the body can be carried out smoothly. Therefore, a user can readily confirm whether the insertion has been made appropriately or not, based on a feel on a lance which feel occurs at the moment of completion of the insertion.

DESCRIPTION OF THE PREFERRED EMBODIMENTS

Next, preferred embodiments of the present invention will be described with reference to the accompanying drawings.

Figure 1:
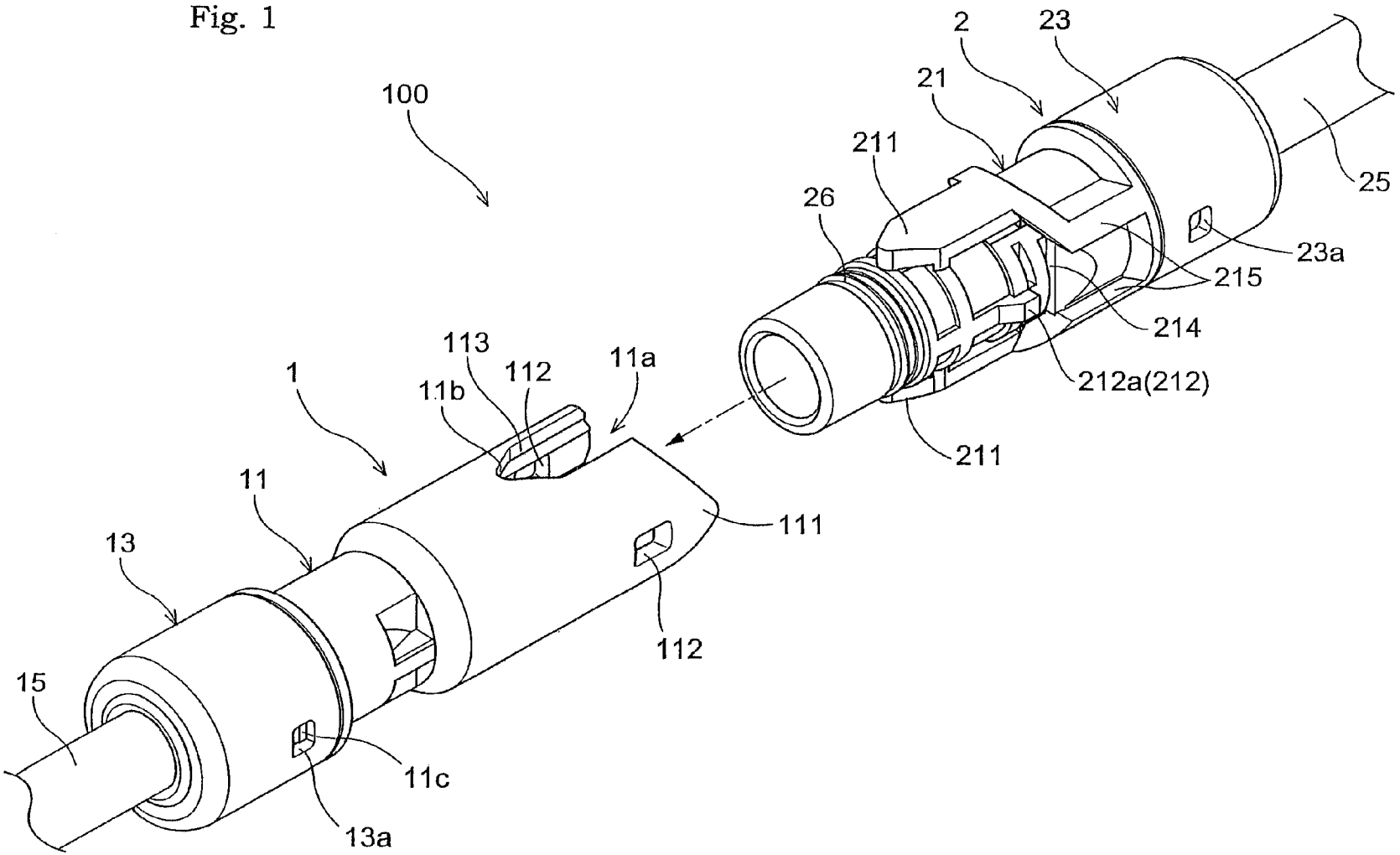
FIG. 1 an upper perspective view showing a connector schematically.

FIG. 1 is an upper perspective view schematically showing a connector 100 relating to the present invention. This connector 100 includes a socket 1 and a plug 2. With this connector 100, by engaging the socket 1 and the plug 2, connection can be realized between a first connecting cable 15 connected to one end of the socket 1 and a second connecting cable 25 connected to one end of the plug 2. Next, this connector 100 will be described in details. Incidentally, in the following discussion of the instant embodiment, the first connecting cable 15 will be referred as a first cable 15 and the second connecting cable 25 will be referred to as a second cable 25.

Figure 2:
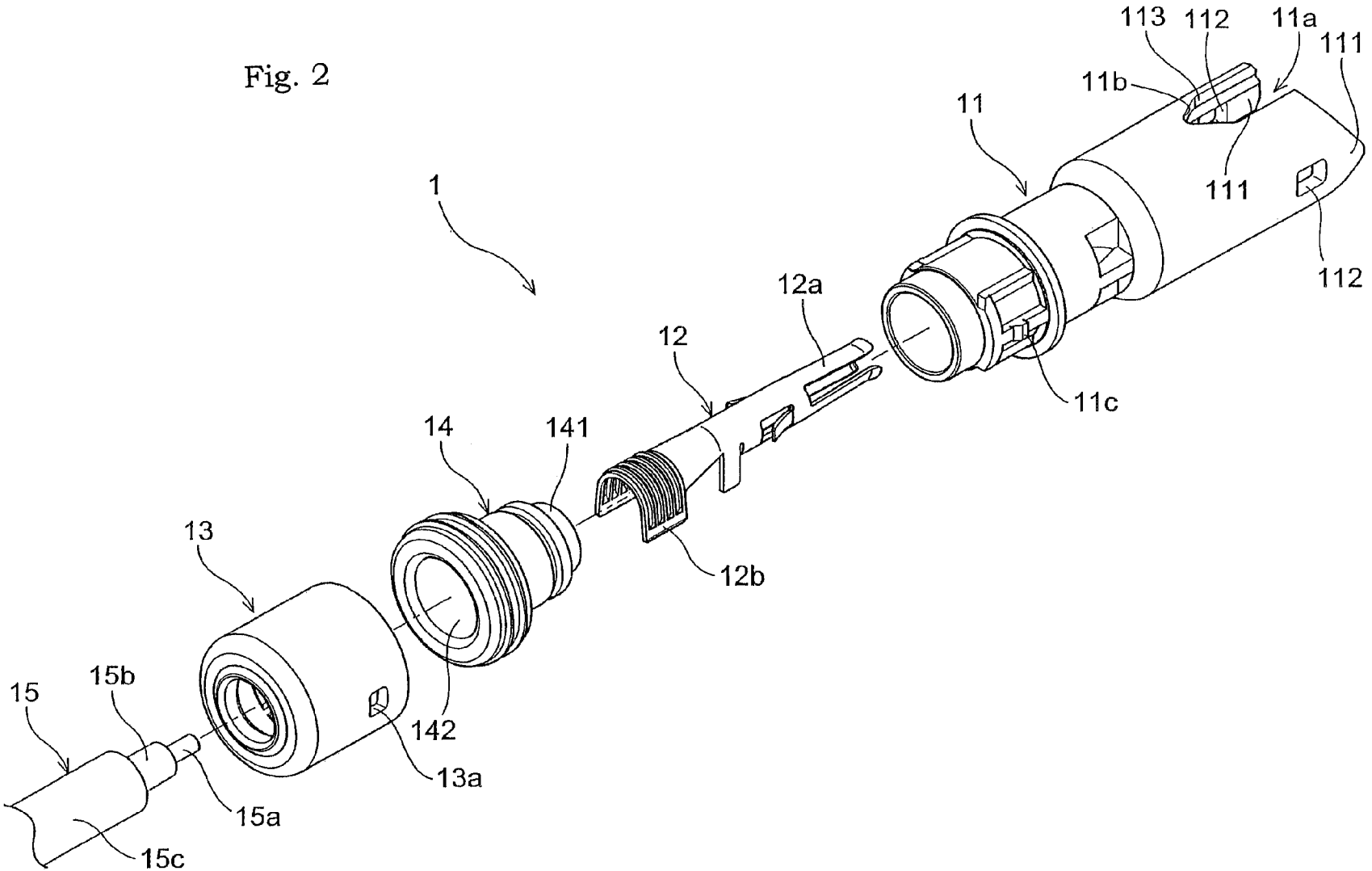
FIG. 2 an developed view of a socket.

FIG. 2 shows the socket 1 under its developed state for facilitating understanding of the construction of the socket 1. As shown, the socket 1 consists essentially of a first body 11, a first contact 12, a first cap 13 and a first cable packing 14. And, a first cable 15 is connected to one terminal end of the socket 1.

The first body 11 has a cylindrical body having a cutout portion 113, a first guiding portion 111 and a retaining portion 112. The cutout portion 113 is formed by cutting away at least one peripheral portion from one opening 11*a* of the cylindrical body in a V-shape with a deepest portion 11*b*. The above-described "one opening 11*a*" refers to the terminal end opposite from the terminal end to which the first cable 15 is connected, as shown in FIG. 1 and this is the terminal end to be engaged with the plug 2. The cutout portion 113 should be provided at least one, but in the instant embodiment, two of them are provided. Therefore, the cutout portions 113 are formed by cutting away two peripheral portions from the opening 11*a*. FIG. 2, as being an upper perspective view, shows only one cutout portion 113, but the other cutout portion 113 is formed on the other side across the axis of the first body 11. Further, the cutout portion 113 is formed in the V-shape with the cutaway deepest portion 11*b*. This V-shape need not be a perfect V-shape. For instance, the deepest portion 11*b* may be formed with some roundness. That is, this portion may be substantially V-shape.

The retaining portion 112 is to be retained to a lateral face of the cylindrical body at the time of engagement with the plug 2. In particular, as shown in FIG. 2, this retaining portion 112 is formed by cutting away a portion with a predetermined shape of the lateral face of the cylindrical body at the area thereof on the front side in the engaging direction. In this regard, upon realization of the engagement between the socket 1 and the plug 2, the retaining portion 112 is retained to a pawl portion 212 provided in the plug 2 to be described later. Therefore, the "predetermined shape" means a shape capable of being retained with the pawl portion 212.

The first contact 12 is formed of a metal that allows electric conduction. One terminal end 12*a* of the first contact 12 is formed with a shape capable of engagement with a second contact 22 of the plug 2 to be described later. The other terminal end 12*b* of the first contact 12 is formed with a shape that allows connection with a core wire 15*a* of the first cable 15. The core wire 15*a* of the first cable 15 is retained to the terminal end 12*b* of the first contact 12 (see FIG. 6) and then these are caulked (or crimped) together. With this, it is possible to prevent inadvertent removal of the core wire 15*a* from the first contact 12, Though will be described in greater details later, when the first cable 15 is to be connected with the socket 1, there is employed the first cable packing 14 which is to be press-fitted with the first insulating portion 15*b* of this first cable 15.

The first cable packing 14 is used for the engagement between the first body 11 and the first cap 13 that constitute the socket 1. The first cable packing 14 forms a small hole portion 141 at one end thereof and a large hole portion 142 at the other end thereof. The inner diameter of the small hole portion 141 is set to be smaller than the outer diameter of the first insulating portion 15*b* that covers the core wire 15*a* of the first cable 15. Namely, the first cable packing 14 will be press-fitted by the radially outer face of the first insulating portion 15*b* and the radially inner face of the small hole portion 141. Therefore, when the first insulating portion 15*b* is inserted into the small hole portion 141, water-tight seal can be provided therebetween (see FIG. 6). Further, in order to further enhance the liquid tightness, the inner diameter of the large hole portion 142 may be set smaller than the outer diameter of the second insulating portion 15*c* that covers the outer side of the first insulating portion 15*b*. That is to say, the first cable packing 14 may be configured to be press-fitted with the radially inner face of the second insulating portion 15*c* and the radially outer face of the large hole portion 142 or configured to be press-fitted with radially outer face of the large hole portion 142 and the radially inner face of the first body 11. Needless to say, the packing may have a same or large diameter. And, this first cable packing 14 is compressed in the course of engagement between the first body 11 and the first cap 13. That is to say, the first cable packing 14 is formed so as to be press-fitted with the engaging-direction wise rear face of the large hole 142 and the engaging-direction wise front face of the first cap 13. Therefore, when the first body 11 and the first cap 13 are engaged with each other (at the time of engagement), the first cable packing 14 will be compressed to fill the gap therebetween.

The first cap 13 is fixed to the first body 11, with covering the first contact 12 clamping the first cable 15 and the first cable packing 14. Preferably, this fixing will be effected such that a cap fixing pawl 11*c* provided in the first body 11 may engage into a hole portion 13*a* formed in the lateral face of the first cap 13.

The first cable 15 comprises a three-layered construction consisting of the core wire 15*a*, the first insulating portion 15*b* covering this core wire 15*a* and the second insulating portion 15*c* covering the first insulating portion 15*b*. The core wire 15*a* is formed of a metal capable of electric conduction. With the above-construction, the socket 1 is provided.

Figure 3:
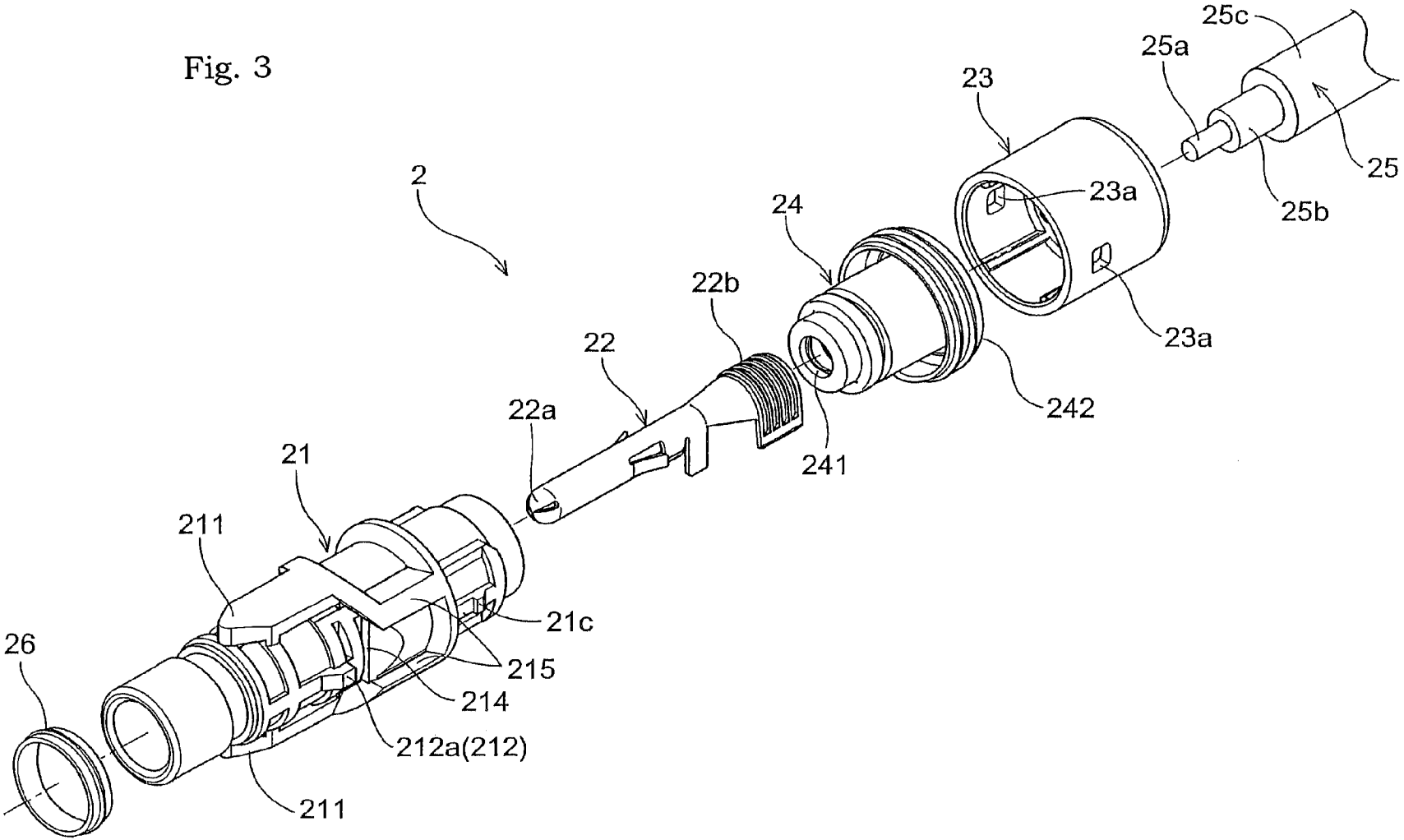
FIG. 3 an developed view of a plug.

FIG. 3 shows the plug 2 under its developed condition for facilitating understanding the construction of this plug 2. The plug 2 consists essentially of a second body 21, a second contact 22, a second cap 23, a second cable packing 24 and a packing 26, and a second cable 25 is connected to this plug 2.

The second body 21 comprises a cylindrical body that defines a second guiding portion 211 and a pawl portion 212. The second guiding portion 211 is to be inserted and engaged with the cutout portion 113 and has a substantially V-shape at its leading end. In the present embodiment, it has been explained that there are provided two cutout portions 113. Therefore, two of the second guiding portions 211 are provided also. Like the cutout portions 113, the second guiding portions 211 are formed to be opposed to each other across the axis of the second body 21. Further, like the first guiding portion 111 described hereinbefore, the second guiding portion 211 need not be perfect V-shaped, but can be substantially V-shaped. Needless to say, the second guiding portion can be formed with roundness.

The pawl portion 212 is to be retained to the retaining portion 112 at the time of the engagement with the socket 1. And, the pawl portion 212 is disposed at a position where it can be retained to the retaining portion 112 so as to prevent easy release of the engagement between the socket 1 and the plug 2. For this reason, upon establishment of retention between the retaining portion 112 of the socket 1 and the pawl portion 212 of the plug 2, it is possible to restrict inadvertent easy release of the engagement between the socket 1 and the plug 2.

The second contact 22 is formed of a metal capable of electric conduction. One terminal end 22*a* of the second contact 22 has a form capable of engagement with the first contact 12 included in the socket 1. Further, the other terminal end 22*b* of the second contact 22 has a form capable of connection with a core wire 25*a* of the second cable 25. The core wire 25*a* of the second cable 25 is retained to the terminal end 22*b* of the second contact 22 (see FIG. 6) and then these are caulked (or crimped) together. With this, it is possible to prevent inadvertent removal of the core wire 25*a* from the second contact 22. Though will be described in greater details, when the second cable 25 is to be connected with the plug 2, there is employed a second cable packing 24 which is to be press-fitted with the first insulating portion 25*b* of this second cable 25.

The second cable packing 24 is used for the engagement between the second body 21 and the second cap 23 that constitute the plug 2. The second cable packing 24 forms a small hole portion 241 at one end thereof and a large hole portion 242 at the other end thereof. The inner diameter of the small hole portion 241 is set to be smaller than the outer diameter of the first insulating portion 25*b* that covers the core wire 25*a* of the second cable 25. Namely, the second cable packing 24 will be press-fitted with the radially outer face of the first insulating portion 25*b* and the radially inner face of the small hole portion 241. Therefore, when the first insulating portion 25*b* is inserted into the small hole portion 241, water-tight seal can be provided therebetween (see FIG. 6). Further, in order to further enhance the liquid tightness, the inner diameter of the large hole portion 242 may be set smaller than the outer diameter of the second insulating portion 25*c* that covers the outer side of the first insulating portion 25*b*. That is to say, the second cable packing 24 may be configured to be press-fitted with the radially inner face of the second insulating portion 25*c* and the radially outer face of the large hole portion 242 or configured to be press-fitted with radially outer face of the large hole portion 242 and the radially inner face of the second body 21. Needless to say, the packing may have a same or large diameter. And, this second cable packing 24 is compressed in the course of engagement between the second body 21 and the second cap 23. That is to say, the second cable packing 24 is formed so as to be press-fitted with the engaging-direction wise rear face of the large hole 242 and the engaging-direction wise front face of the second cap 23. Therefore, when the second body 21 and the second cap 23 are engaged with each other (at the time of engagement), the second cable packing 24 will be collapsed to fill the gap therebetween.

The second cap 23 is fixed to the second body 21, with covering the second contact 22 clamping the second cable 25 and the second cable packing 24. Preferably, this fixing will be effected such that a cap fixing pawl 21*c* provided in the second body 21 may engage into a hole portion 23*a* formed in the lateral face of the second cap 23.

The second cable 25 comprises a three-layered construction consisting of the core wire 25*a*, the first insulating portion 25*b* covering this core wire 25*a* and the second insulating portion 25*c* covering the first insulating portion 25*b*. The core wire 25*a* is formed of a metal capable of electric conduction.

The packing 26 is provided around the second body 21 and is compressed at the time of the engagement between the socket 1 and the plug 2, thereby to fill the gap between the socket 1 and the plug 2. The language "around the second body 21" refers to the outer periphery of the second body 21. At the time of the engagement between the socket 1 and the plug 2, the packing 26 functions to fill the gap between the outer periphery of the second body 21 and the inner periphery of the first body 11. So, the first contact 12 and the second contact 22 can be engaged in liquid-tight manner. In this way, the plug 2 is constructed. Incidentally, the packing 26 can be provided as an O-ring.

Figure 4:
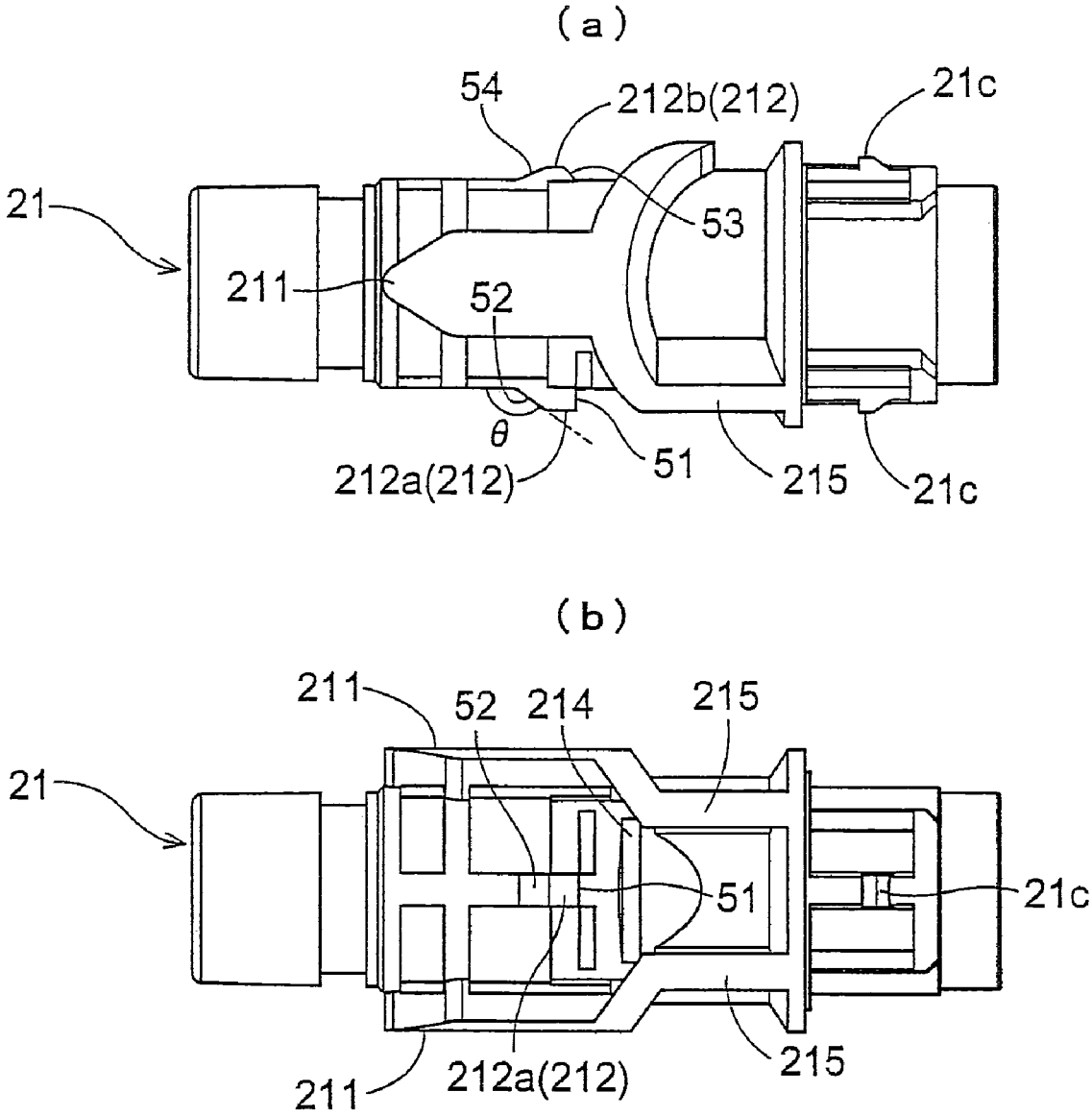
FIG. 4 a view showing a second body in such a manner that a second guiding portion is located on the front side from a direction normal to an engaging direction, FIG. 5 a view illustrating engagement between the socket and the plug, FIG. 6 a diagram schematically showing cross section under an engaged condition between the socket and the plug, FIG. 7 a view illustrating releasing of the engagement between the socket and the plug, FIG. 8 a view showing a plug relating to a further embodiment, FIG. 9 a view illustrating connection using a ring, and FIG. 10 a view illustrating connection using a cable packing relating to a further embodiment.

FIG. 4(*a*) shows the second body 21 such that the second guiding portion 211 may be located on the front side from the direction normal to the engaging direction. FIG. 4(*b*) is a view rotated by 90 degrees from FIG. 4(*a*), along the axial direction of the second body 21. At lateral face portions of the second body 21, there are provided two pawl portions 212. One 212*a* of the pawl portions 212 includes, on the rear side in the engaging direction between the socket 1 and the plug 2, a perpendicular face 51 perpendicular to the engaging direction and includes, on the front side in the engaging direction, an inclined face 52 inclined to the rear side in the engaging direction, and has a trapezoidal cross section in the axial direction.

The rear side in the engaging direction is the side to which the second cable 25 is connected. Therefore, of the faces of the pawl portion 212*a*, the perpendicular face 212*a* is the face on the side for the connection with the second cable 25. Further, the perpendicular face 51 is formed to be perpendicular to the engaging direction. The language "perpendicular to the engaging direction" is not limited to being exactly perpendicular. It can be formed with a few degrees offset from the perpendicular, for instance.

Further, the front side in the engaging direction is the side for the engagement with the socket 1. Therefore, of the faces of the pawl portion 212*a*, the inclined face 52 is the face on the side for the engagement with the socket 1. Further, the inclined face 52 is formed to be inclined to the rear side in the engaging direction. More particularly, it is formed such that an angle θ formed by the lateral face portion of the second body 21 parallel with its axial direction and the inclined face 52 is greater than 90 degrees and smaller than 180 degrees. With these faces, the pawl portion 212*a* is formed to have the trapezoidal axial cross section along the axial direction of the plug 2, as shown in FIG. 4(*a*).

Figure 7:
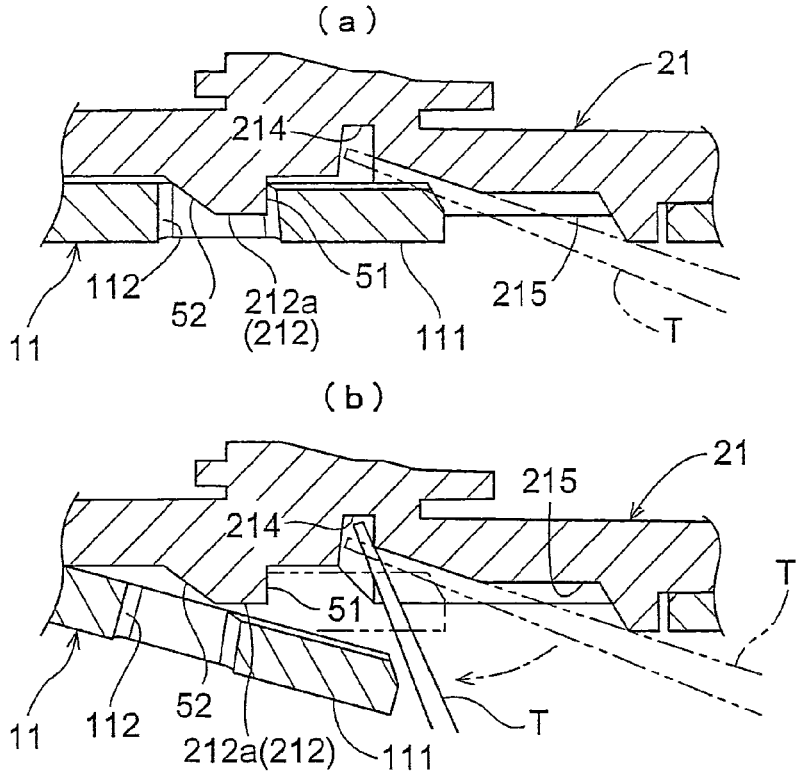

The plug 2, as shown in FIG. 4(*b*), includes a recess 214 having a predetermined depth formed on the rear side of one 212*a* of the pawl portions 212 in the engaging direction (see FIG. 7). Further, the plug 2 includes also at least two ribs 215 with a spacing therebetween smaller than the width of the recess 214, the ribs extending along the axial direction of the plug 2. This recess 214 and the rib 215 are used when the retained condition between the retaining portion 112 of the first body 11 and the pawl portion 212*a* of the second body 21 is to be released (this will be described in details later).

Figure 5:
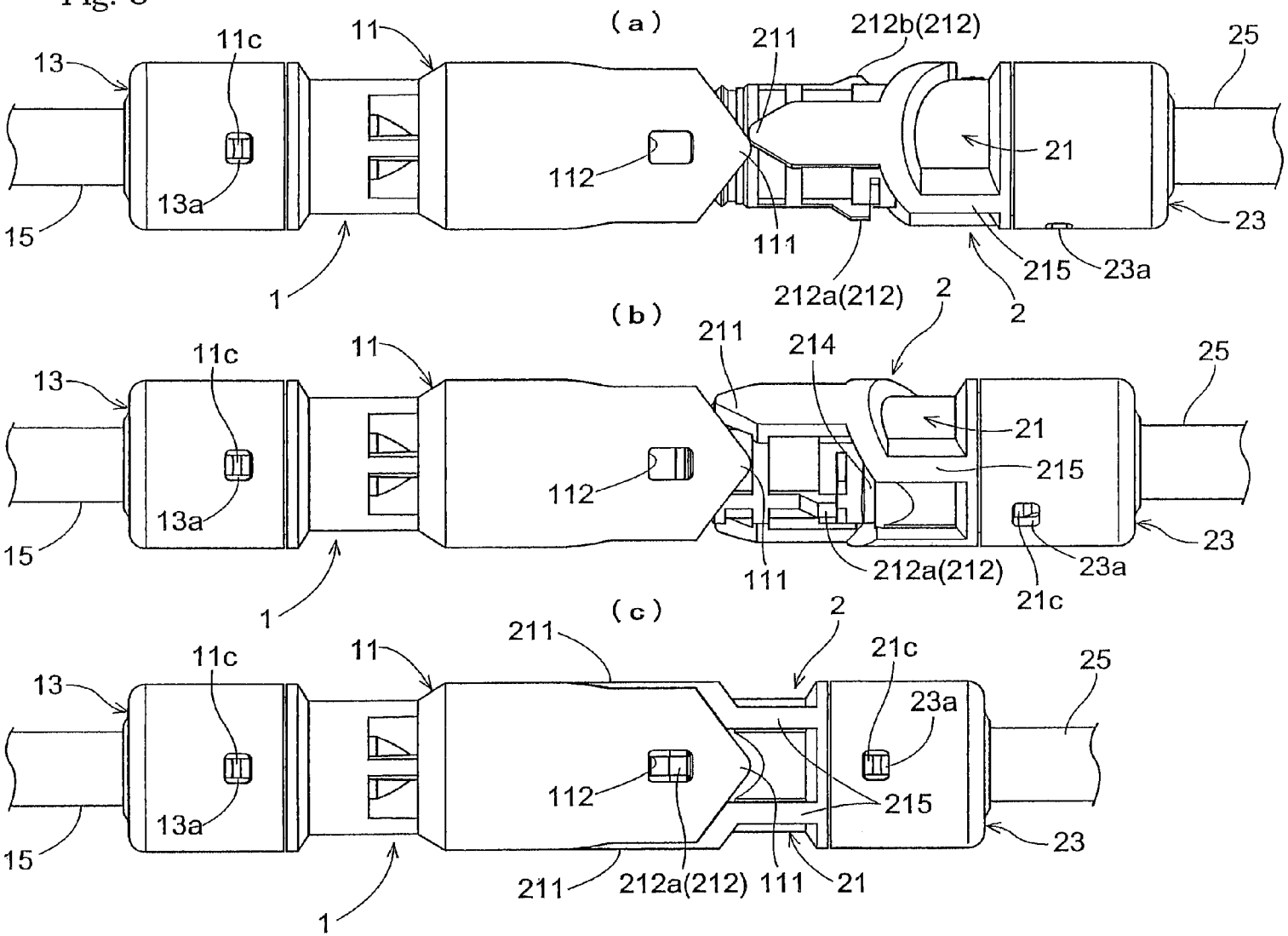

Next, the engagement between the socket 1 and the plug 2 will be described with reference to FIG. 5. FIG. 5(*a*) is a view showing the initial stage of the operation for engaging the plug 2 to the socket 1. As shown in FIG. 5(*a*), even if there exists a positional error in the peripheral direction at the initial stage, as the plug 2 is advanced to the deeper side of the engagement, the first guiding portion 111 of the first body 11 and the second guiding portion 211 of the second body 21 are corrected respectively according to the faces in contact respectively therewith to the predetermined engagement positions in the peripheral direction of the plug 2. Further, as the plug 2 is advanced to the deeper side in the engagement, as shown in FIG. 5(*c*), the position in the peripheral direction of the plug 2 is corrected, thereby to complete the engagement between the socket 1 and the plug 2. In this, the engagement is retained as the pawl portions 212*a* of the second body 21 are retained to the retaining portions 112 of the first body 11.

Figure 6:
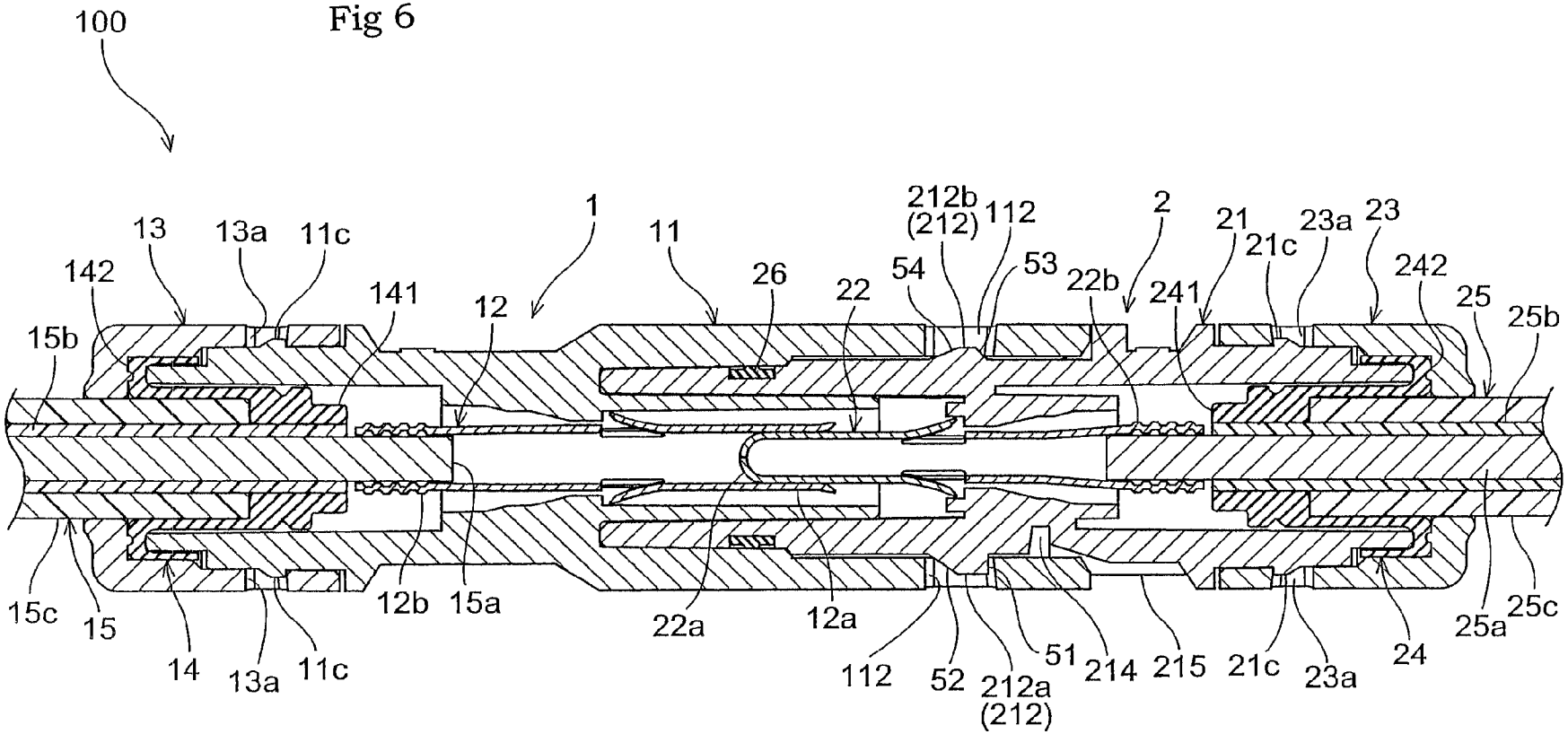

Here, FIG. 6 is a figure schematically showing the cross section when the socket 1 and the plug 2 are engaged with each other. As shown in FIG. 6, when the socket 1 and the plug 2 are engaged with each other, the packing 26 is collapsed by the compressive stress, thus appropriately filing the gap between the first body 11 and the second body 21. Therefore, the engaged portion between the socket 1 and the plug 2 can be engaged in liquid-tight manner.

Further, as the first contact 12 connected to the core wire 15*a* of the first cable 15 is engaged with the second contact 22 connected to the core wire 25*a* of the second cable 25, electrically conductive connection is established between the first cable 15 and the second cable 25.

Moreover, as shown in FIG. 6, liquid-tightness is ensured between the first insulating portion 15*b* of the first cable 15 and the small hole portion 141 of the first cable packing 14, and as the first cable packing 14 is clamped between the first body 11 and the first cap 13, the first cable packing 14 ensures liquid-tightness between the first body 11 and the first cap 13, so that the liquid-tightness of the core wire 15*a* is ensured. Also, as the first cable packing 14 is press-fitted with the first body 11 and the first cap 13, the inserting operation for inserting the first contact 12 into the first body 11 can be carried out smoothly. Hence, the user can readily recognize whether the insertion has been carried out appropriately or not, based on a feel of the lance that occurs upon completion of the insertion.

Similarly, liquid-tightness is ensured between the first insulating portion 25*b* of the second cable 25 and the small hole portion 241 of the second cable packing 24 and as the second cable packing 24 is clamped between the second body 21 and the second cap 23, liquid-tightness is ensured between the second body 21 and the second cap 23. Hence, liquid-tightness of the core wire 25*a* can be ensured. Also, as the second cable packing 24 is press-fitted with the second body 21 and the second cap 23, the inserting operation for inserting the second contact 22 into the second body 21 can be carried out smoothly. Hence, the user can readily recognize whether the insertion has been carried out appropriately or not, based on a feel of the lance that occurs upon completion of the insertion.

Next, the procedure for releasing the engagement between the socket 1 and the plug 2 will be explained with reference to FIG. 7. When the socket 1 and the plug 2 are engaged with each other, as shown in FIG. 7(*a*), the retaining portion 112 of the first body 11 is retained to the pawl portion 212*a* of the second body 21. So, for releasing the engagement between the socket 1 and the plug 2, it is necessary first to release the retention between the retaining portion 112 of the first body 11 and the pawl portion 212*a* of the second body 21. To this end, on the rear side in the engaging direction of the pawl portion 212 of the plug 2, there is provided a space that allows release by a tool. In the following discussion of the instant embodiment, this tool will be described is a rigid member T as described below. And, it is further assumed that the space is the gap between the two ribs 215 delimited by the first guiding portion 111 and the second body 21.

As shown in FIG. 7(*b*), by inserting the narrow plate-like rigid member T provided like a minus driver or the like is inserted into the gap delimited by the first guiding portion 111 and the second body 21 between the two ribs 215, and then pivotally raising this rigid member by utilizing the principle of leverage, about the inserted position as the pivotal point, the retention between the retaining portion 112 of the socket 1 and the pawl portion 212*a* of the plug 2 can be readily released. Then, under this condition, the engagement can be released by pulling the socket 1 and the plug 2 in opposite directions. Incidentally, the rigid tool T is not limited to a minus driver.

In the foregoing embodiment, two cutout portions 113 are formed in the first body 11. However, the present invention is not limited thereto. For instance, only one cutout portion 3 may be provided. Or, two or more of them can be provided. In such case, by forming the same number of second guiding portion(s) 211 in the second body 21 in correspondence with the position(s) of the cutout portion(s) 13, the same advantageous effect of the present invention can be achieved as a matter of course.

Figure 8:
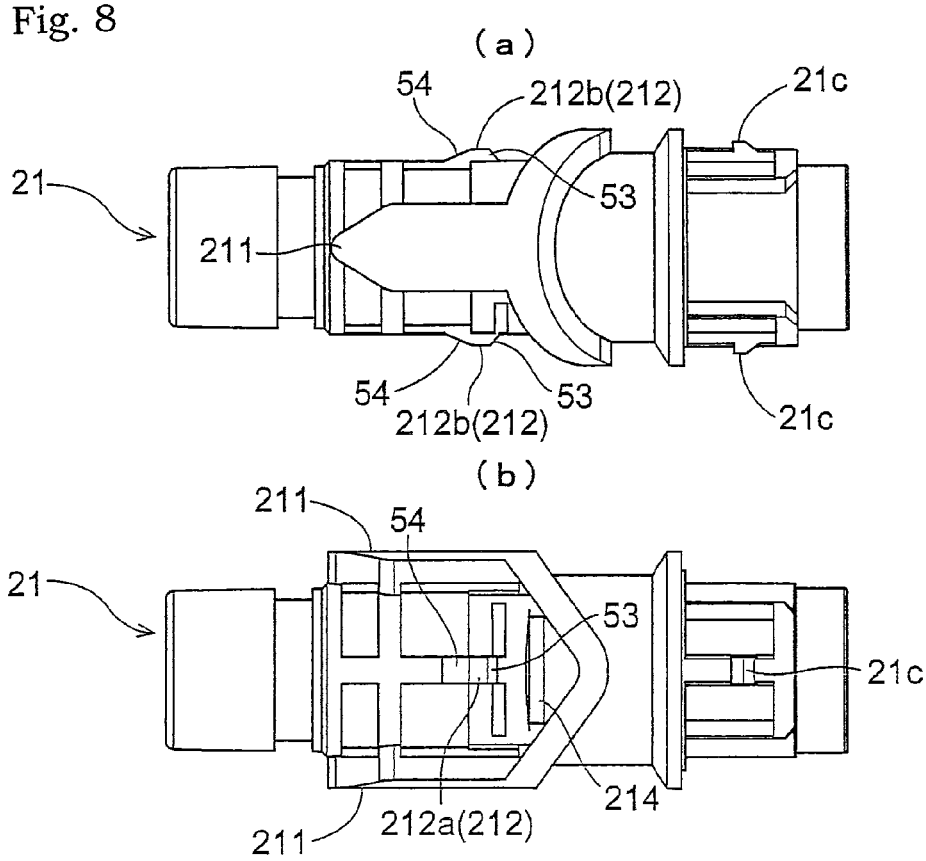

In the foregoing embodiment, in order to prevent easy inadvertent release of the engagement between the socket 1 and the plug 2, retention is provided as the pawl portion 212*a* of the second body 21 is retained to the retaining portion 112 of the first body 11. However, the present invention is not limited to such arrangement. For instance, it is possible, as a matter of course, to arrange such that the engagement between the socket 1 and the plug 2 may be relatively easily released when necessary. In such case, instead of forming the pawl portion 212*a* having the perpendicular face 51 on the rear side in the engaging direction, there should be formed, on the front side in the engaging direction, a pawl portion 212*b* having an inclined face 53 inclined to the front side in the engaging direction. And, in such case, it will also be possible as a matter of course to form the second body 21 not having the two ribs 215, as illustrated in FIG. 8(*b*).

In the foregoing discussion of the embodiment, of the pawl portions 212, one pawl portion 212*a* has the perpendicular face on the rear side in the engaging direction and the other pawl portion 212*b* has the inclined face 53 inclined to the front side in the engaging direction. However, the present invention is not limited to such arrangement. Though not shown, it is possible to arrange such that each and every pawl portion 212 has, on the rear side in the engaging direction, a perpendicular face 51 perpendicular to the engaging direction, thereby to make the release of engagement more difficult. And, in order to release the engagement, ribs 215 can be provided, as a matter of course.

Figure 9:
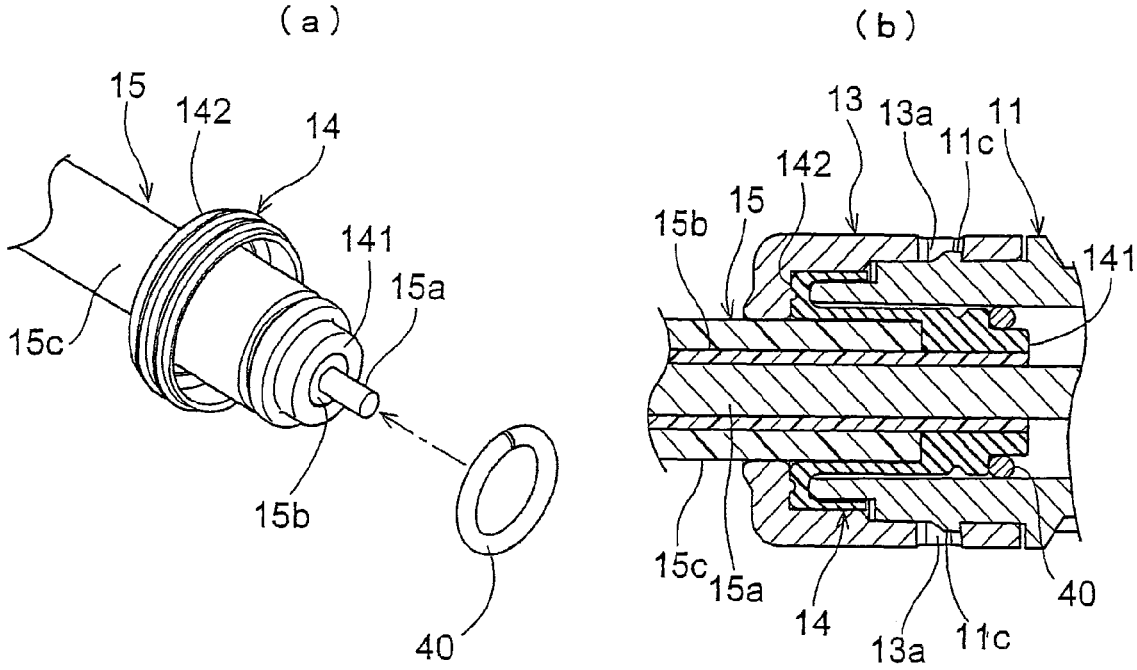

In the foregoing embodiment, it has been explained that the liquid-tightness between the first body 11 and the first cable 15 is maintained with the cable packing 14. It is possible to further enhance the liquid-tightness of these as follows. In such case, as shown in FIG. 9(*a*) and FIG. 9(*b*), this can be realized by attaching a ring 40 to the outer peripheral end of the small hole portion 141 of the cable packing 14 through which the first cable 15 is inserted. As shown in FIG. 9(*b*), needless to say, also by fastening the outer peripheral end of the small hole portion 141 of the cable packing 14 with the ring 40, the liquid-tightness between the cable packing 14 and the first cable 15 (especially, the first insulating portion 15*b*) can be further enhanced.

In the foregoing discussion of the embodiment, the liquid-tightness is ensured with the first insulating portion 15*b* of the first cable 15 and the small hole portion 141 of the first cable packing 14 and the liquid tightness is ensured also by clamping the first cable packing 14 between the first body 11 and the first cap 13. However, the present invention is not limited thereto. Alternatively, the above arrangement can be realized without using the first cap 13. In such case, the first cable packing 14 will be press-fitted with the radially outer face of the first insulating portion 15 and the radially inner face of the small hole portion 141 and press-fitted with the radially outer face of the second insulating portion 15*c* and the radially inner face of the large hole portion 142 and further press-fitted with the radially outer face of the large hole portion 142 and the radially inner face of the first body 11. With such alternative construction too, the liquid-tightness can be ensured as a matter of course. According to a still further arrangement, the outer diameter of the small hole portion 141 of the first cable packing 14 is set equal to the inner diameter of the first body 11, thus eliminating the gap between the small hole portion 141 and the first body 11.

Further, in the case of the arrangement not using the first cap 13, the shape of the first cable packing 14 may be modified such that this first cable packing 14 is press-fitted with the radially outer face of the first insulating portion 15*b* and the radially inner face of the small hole portion 141 and press-fitted with the radially outer face of the small hole portion 141 and the radially inner face of the first body 11. That is, advantageously, the outer diameter of the small portion 141 of the first cable packing 14 may be set greater than the inner diameter of the first body 11. With this alternative arrangement too, liquid-tightness can be ensured as a matter of course. Incidentally, in the above, the ensuring of liquid-tightness between the first body 11 and the first cable 15 has been described. Similarly, it is needless to say that the liquid-tightness between the second body 21 and the second cable 25 can also be ensured with using the second cable packing 24.

Figure 10:
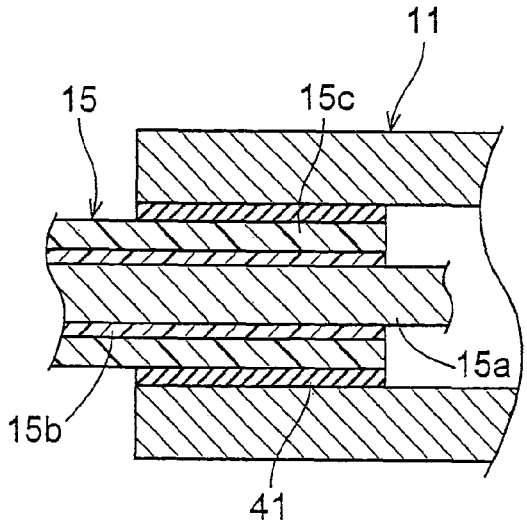

In the foregoing embodiment, it has been explained that the liquid-tightness is ensured by the first insulating portion 15*b* of the first cable 15 and the small hole portion 141 of the first cable packing 14 and the liquid-tightness is ensured by clamping the first cable packing 14 between the first body 11 and the first cap 13. However, the present invention is not limited to such arrangement. For instance, as shown in FIG. 10, the liquid-tightness between the first cable 15 and the cable packing 41 can be maintained by covering the outer periphery of the second insulating portion 15*c* of the first cable 15 with a cylindrical cable packing 41 having a smaller inner diameter than at least this outer periphery. That is, the liquid-tightness can be ensured by press-fitting the cable packing 41 with the radially outer face of the second insulating portion 15*c* and the radially inner face of the cable packing 41. Also, the liquid-tightness between the first body 11 and the cable packing 41 can be maintained by setting the outer diameter of the cable packing 41 greater than at least the inner diameter of the first body 11. That is, the liquid-tightness can be maintained by press-fitting the cable packing 41 with the radially outer face of the cable packing 41 and the radially inner face of the first body 11. Therefore, with use of these arrangements. it is possible to ensure the liquid-tightness between the first body 11 and the first cable 15, without using the first cap 13. In the above, ensuring of the liquid-tightness between the first body 11 and the first cable 15 has been described. Needless to say, the liquid-tightness between the second body 21 and the second cable 25 can be ensured by using a similar cable packing 41.

Further, though not shown, in the arrangement shown in FIG. 10 for instance, the liquid-tightness can be enhanced with using the first cap 13. In such case, the cable packing 41 will be press-fitted with the engaging direction wise rear face of the cable packing 41 and the engaging-direction wise front face of the first cap 13. Thus, the liquid-tightness can be enhanced by the cable packing 41 and the first cap 13.

In the foregoing embodiment, the first guiding portion 111 and the second guiding portion 211 have been described as being substantially V-shaped. However, the present invention is not limited thereto. For instance, it is possible as a matter of course to form at least either one of the first guiding portion 111 and the second guiding portion 211 not substantially V-shaped, but formed with some roundness (e.g. U-shaped). Or, the shape can be modified appropriately in any other manner as long as such modified shape too can achieve the above-described advantageous effect.

In the foregoing embodiment, it has been described that the first connecting cable 15 is the first cable 15 and the second connecting cable 25 is the second cable 25. However, the present invention is not limited thereto. For instance, either one of the first connecting cable 15 and the second connecting cable 25 can be provided as the socket 1 or plug 2 included in various devices. That is, the connector 100 can be a connector 100 for inter-substrate, i.e. substrate-to-substrate connection, rather than the cable-to-cable, i.e. inter-cable connection or can be a connector 100 for connecting between a cable and a substance. In such case, the connection patterns formed within the substance will correspond to the first connecting cable 15 and/or the second connecting cable 25. Also, in such case, the connector construction can be formed without using the cable packing 14 or the cable packing 24.

In the foregoing embodiment, it has been explained that two of the ribs 215 are provided. However, the present invention is not limited thereto. Further, the width of the rib 215 can be smaller or larger than or equal to the width of the recess 214.

In the foregoing embodiment, the plug 2 includes the recess 214 and includes also the ribs 215. However, the present invention is not limited thereto. For instance, the plug can be formed without the ribs 215. Also, the socket 1 can be provided with the recess 214. In such case, advantageously, the portion of the pawl portion 212 of the socket 1 on the rear side in the engaging direction will be formed thin.

The present invention is applicable to a connector for connecting a first connecting cable connected to one end of a socket and a second connecting cable connected to one end of a plug, through engagement between the socket and the plug.

DESCRIPTION OF REFERENCE NUMERALS AND MARKS

1: socket
2: plug
11: first body
11*a*: opening
11*b*: deepest portion
13: first cap
13*a*: hole portion
15: first cable (first connecting cable)
15*a*: core wire
15*b*: first insulating portion
15*c*: second insulating portion
21: second body
23: second cap
23*a*: hole portion
25: second cable (second connecting cable)
100: connector
111: first guiding portion
112: retaining portion
113: cutout portion
211: second guiding portion
212: pawl portion

The invention claimed is:

1. A connector for connecting a first connecting cable connected to one end of a socket and a second connecting cable connected to one end of a plug, through engagement between the socket and the plug, wherein said socket includes:

a cutout portion formed by cutting away at least one portion from one opening of a cylinder along the peripheral direction thereof, the cutout portion having a V-shape at its deepest portion;

a first guiding portion projecting from at least one portion of said opening along the peripheral direction, the first guiding portion having a substantial V-shape at its leading end, and a retaining portion to be retained to a lateral face of said cylinder at the time of engagement with the plug, thus retaining this engagement;

wherein said plug includes:

a second guiding portion engageable into said cutout portion and having a substantial V-shape at its leading end; and a pawl portion to be retained to said retaining portion at the time of the engagement with the socket.

2. The connector according to claim 1, wherein said pawl portion includes, on its rear side in the engaging direction of the socket and the plug, a perpendicular face perpendicular to said engaging direction and includes also, on its front side in the engaging direction, an inclined face inclined to the rear side in the engaging direction, and the pawl portion has a trapezoidal shape in its axial cross section.

3. The connector according to claim 2, wherein on the rear side in the engaging direction of the pawl portion, at least one of the plug and the socket includes a space that allows release by a tool.

4. The connector according to claim 3, wherein said plug includes a recess having a predetermined depth.

5. The connector according to claim 4, wherein said plug forms a rib along the axial direction thereof.

6. The connector according to claim 4, wherein at least one of said first connecting cable and said second connecting cable comprises a three-layered cable having a core wire, a first insulating portion covering the core wire and a second insulating portion covering the first insulating portion; and when said cable is to be connected to at least one of said socket and said plug, there is employed a cable packing to be press-fitted with said first insulating portion.

7. The connector according to claim 6, wherein said cable packing is configured to be compressed upon engagement between at least one of a body constituting said socket and a body constituting said plug and a cap fixed on said bodies to cover said cable packing, thereby to fill the gap therebetween.

* * * * *